US005873504A

United States Patent [19]

Farmer

[11] Patent Number: 5,873,504

[45] Date of Patent: Feb. 23, 1999

[54] CARRYING BAG

[76] Inventor: Edmund L. Farmer, 2323 Stewart Ave. Unit F, Silver Springs, Md. 20910

[21] Appl. No.: 643,049

[22] Filed: May 2, 1996

[51] Int. Cl.[6] ..... A45F 4/02

[52] U.S. Cl. ..... 224/576; 224/153; 224/575; 224/581; 224/582; 224/583; 224/653; 150/113; 150/117; 190/110; 190/111

[58] Field of Search ..... 224/219, 222, 224/575, 576, 581, 582, 583, 653, 153; 150/113, 117; 190/110, 111

[56] References Cited

U.S. PATENT DOCUMENTS

| | | | |
|---|---|---|---|
| 4,545,414 | 10/1985 | Baum | 224/908 |
| 4,756,394 | 7/1988 | Cohen | 190/110 |
| 5,025,965 | 6/1991 | Smith | 224/660 |
| 5,205,448 | 4/1993 | Kester et al. | 224/575 |
| 5,267,679 | 12/1993 | Kamaya et al. | 224/583 |
| 5,307,908 | 5/1994 | Shyr et al. | 190/111 |
| 5,544,792 | 8/1996 | Arnwine | 224/583 |

FOREIGN PATENT DOCUMENTS

| | | | |
|---|---|---|---|
| 154365 | 7/1932 | Switzerland | 224/153 |

*Primary Examiner*—Henry J. Recla
*Assistant Examiner*—Timothy L. Maust
*Attorney, Agent, or Firm*—Barnes, Kisselle, Raisch, Choate, Whittemore & Hulbert, P.C.

[57] ABSTRACT

A carrying bag (20) formed of flexible material includes an upper compartment (86) and a lower compartment (90) separated by a dividing wall (86). A zippered closure (27) extending around three sides of the bag allows access to the lower compartment and permits the upper compartment to be pivoted away from the lower compartment. The lower compartment includes a unitary, divided tray (84) for storing articles therein. A detachable article, such as a wearable pouch (42), is releasably attached to one side of the bag by means of quick-release clip locks (30). The pouch includes a pocket (65) for storing a strap assembly (68, 70) which may be deployed around the waist of a user to convert the pouch to a fanny pack.

10 Claims, 5 Drawing Sheets

CARRYING BAG

TECHNICAL FIELD

The present invention generally relates to bags, especially of the soft-sided type, for carrying articles, and deals more particularly with a carrying bag having multiple compartments and detachable accessories thereon.

BACKGROUND ART

Carrying bags, particularly of the soft-sided, lightweight type, have found increasing use in recent years. The popularity of these bags is partially due to the fact that they may be provided with strategically located, separate pockets and other features that allow a user to gain quick access to stored articles. Because of their lightweight, such bags have come to replace heavier, hard-sided containers which, in the past, have been used for a variety of specialized applications, such as tool boxes, fishing lure boxes, sports bags and the like.

Because of the tendency to store more and diverse articles in these lightweight, specialized bags, they have, in some cases, become rather heavy, large and bulky. Larger, heavier articles tend to move around and sometimes place stress concentrations on weaker portions of the bag. This is particularly true where the soft elements and hard elements of the bag are not firmly fixed together. These disadvantages limit the use of these bags for certain applications. It would therefore be desirable to provide a commodious bag for storing a large number of specialized articles, but which affords the user the option of detaching certain portions of the bag, or accessories mounted thereon, so that these items may be carried or worn by the user without the need for carrying the entire bag. It would also be advantageous to provide a bag of this type which structurally ties the soft and hard elements together into a unified assembly. The present invention is directed toward satisfying these needs.

SUMMARY OF THE INVENTION

According to the present invention, a multipurpose, lightweight carrying bag for storing and carrying specialized articles includes a main bag body, an accessory, and means for releasably mounting the accessory on the main bag body. The bag body includes upper and lower portions, respectively defining upper and lower compartments which are separated by a zipper allowing the upper portion to be pivoted away from the bottom portion to reveal an article storing rigid tray, preferably formed of one-piece, molded construction which is mechanically fastened to the bag to provide a unitary, solid construction. Each of the tray compartments may be configured to receive an insert for holding specialty items therein. In the disclosed embodiment, the accessory comprises a wearable pouch which functions as an ordinary storage pocket when attached to the main bag body, but which may be released from the bag via quick disconnect connections. The pouch includes a zippered pocket in which there is stored a deployable strap assembly which may be removed and secured around the waist of a user, thus converting the bag pouch into a "fanny pack."

Accordingly, it is a primary object of the present invention to provide a carrying bag having a plurality of storage compartments that are particularly suited for storing specialized articles, such as sports specific items for example.

It is a further object of the present invention to provide a carrying bag of the type described above which allows the user easy, independent access to each of the storage compartments.

It is a further object of the present invention to provide a carrying bag as described above which is formed of lightweight, flexible material, but which includes reinforced, rigid sections affording protection of certain articles against impact and rough handling.

A still further object of the present invention is to provide a carrying bag having carrying pouches which are detachable from the bag and may be used as separate accessory items, such as a fanny pack wearable around the waist of the user.

These, and further objects of the invention will be made clear or will become apparent during the course of the following description of a preferred embodiment of the invention.

BRIEF DESCRIPTION OF THE DRAWINGS

In the drawings, which form an integral part of the specification and are to be read in conjunction therewith, and in which like reference numerals designate identical components in the various views.

DESCRIPTION OF THE PREFERRED EMBODIMENT

Figure 2:
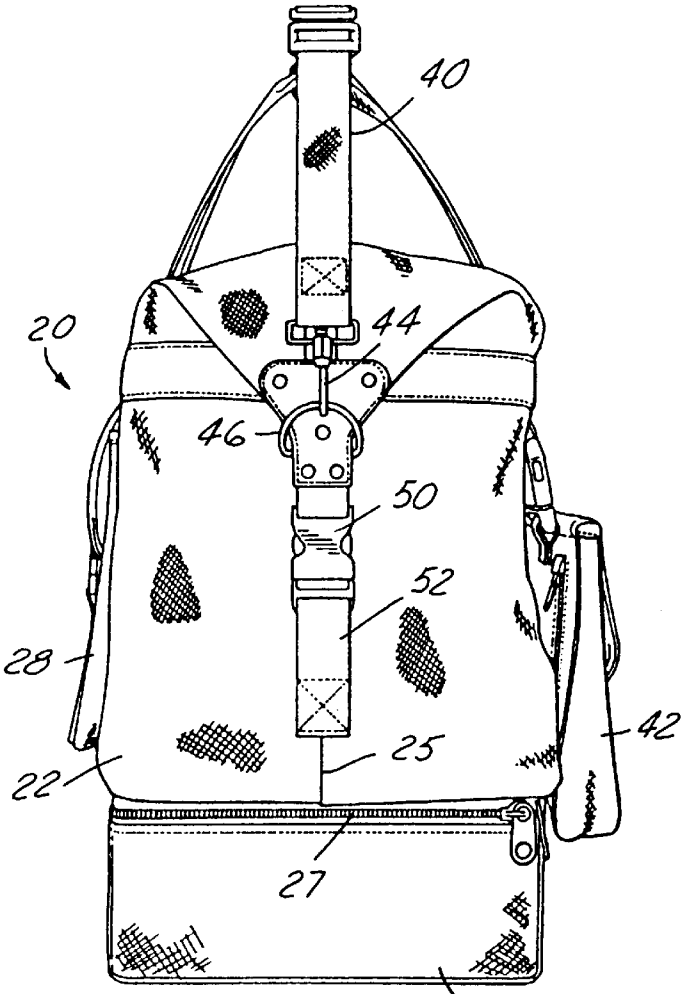
FIG. 2 is an end view of the bag of FIG. 1.

Referring now to the drawings, the present invention relates to a carrying bag, generally indicated by the numeral 20 in FIGS. 1–4, which is suitable for use in specialized applications such as sports. The bag 20 includes a main body portion 22 preferably formed from of a flexible but tear resistant synthetic fabric, such as nylon. If desired, certain portions of the bag body 22 may be covered with a protective overlay of flexible plastic or rubberized material.

The bag body 22 includes an upper portion 24 and a lower portion 26 respectively defining upper and lower compartments 88, 90. The upper portion 24 is essentially formed of two halves joined, as by sewing to form a central seam 25. One side of the bag body 22 includes a pair of sewn-on pouches 28 having flap pockets securable with conventional, quick release clip locks 30, which may be of a conventional plastic molded type. The bag 20 may be carried by a handle assembly which comprises a pair of straps 32 secured on opposite sides of the bag body 22. Specifically, the opposite ends of each strap 32 are fastened as by sewing to a corresponding side of the bag 20, and a longitudinally extending strip 34 of reinforcing material such as nylon is sewn to the bag in overlying relationship to the ends of the straps 32, thereby reinforcing the strap connection to the bag. If desired, a flexible, cushioned handle 38 may be disposed around the central section of the handle straps 32.

Figure 3:
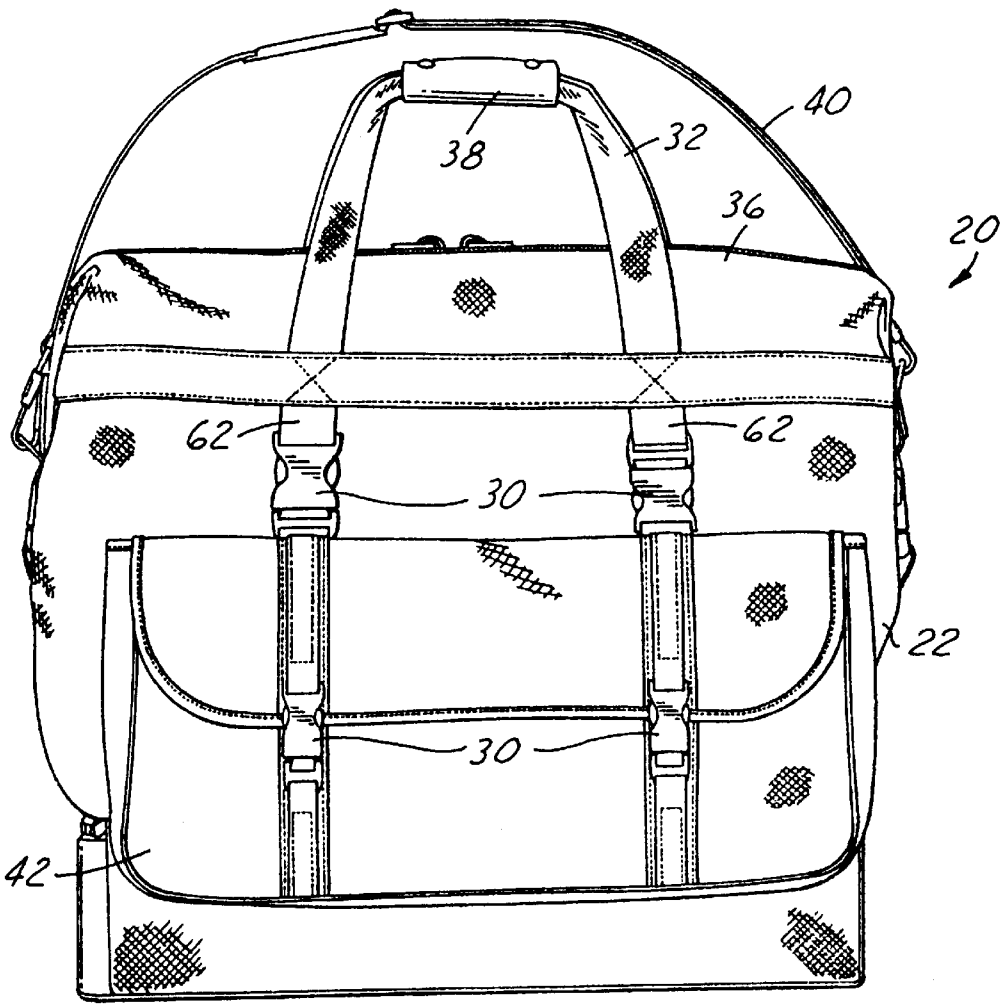
FIG. 3 is an elevational view of the opposite side of the bag of FIG. 1.
Figure 9:
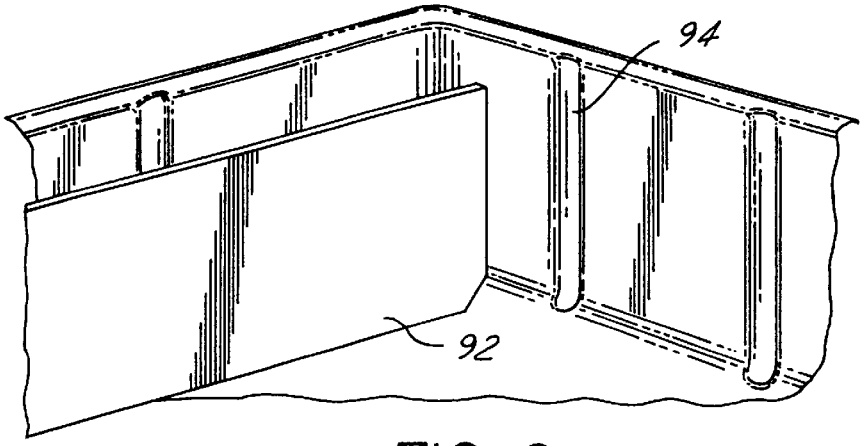
FIG. 9 is a perspective, exploded fragmentary view showing the relation of a partition and a tray.

As best seen in FIG. 3, one of the straps 32 on the side of the bag body 22 opposite the pouches 28 terminates in a pair of loops 62 to which there are respectively attached a first portion of quick-disconnect clip locks 30. A second portion of the clip locks 30 is connected via a strap loop 62 to an accessory which is disclosed herein as a pouch 42. However, it is to be understood that numerous other accessories might be mounted on the bag body 22 in this same manner. In any event, the accessory pouch 42 is suspended from the loops 62, and a substantial portion of the weight of the accessory pouch 42 is transmitted from the loops 62 directly to one of the handle straps 32 which are formed integral with the loops 62. Moreover, the loop mounting of the pouch 42 allows the pouch to pivot outwardly away from the bag body for purposes that will become apparent later.

Referring now particularly FIGS. 3, 6, 7 and 12, the accessory pouch 42 comprises a pair of forward walls 56, 58 which are spaced apart to define a pouch or storage area therebetween, within which articles may be stored. A flap 54 covers the top opening of the pouch 42 and may be secured in overlying relationship to the forward wall 56 by means of a quick-disconnect clip lock 30. A rear wall 60 is sewn on of the backside of the forward wall 58 to define a storage pocket 65, within which there is stored a pair of strap assemblies 68, 70. Strap assembly 68 includes a pair of straps 68*a*, 68*b* which may be of nylon or the like, the opposite ends of which are sewn to either the rear wall 60 or the forward wall 58. Likewise, strap assembly 70 comprises a pair of straps 70*a*, 70*b* which are also sewn either to the rear wall 60 or forward wall 58. The strap assemblies 68, 70 are provided with a suitable releasable connection for interconnecting their opposite ends, such connections being shown in the drawings as a quick-release buckle-type device comprising a male connector 76 on an outer strap 72 and a female connector 78 on the strap assembly 68. The outer strap 72 is adjustable by means of a buckle arrangement 74 connected to the strap assembly 70.

The rear wall 60 includes a pair of longitudinally spaced openings which are normally closed by a corresponding pair of closures which may comprise zippers 64, although Velcro or other closure means may be employed if desired. The strap assembly 68, 70 are normally stored within the pocket 65 defined between walls 58, 60, and thus do not interfere with the use of the pouch 42 as a normal storage compartment on one side of the bag 20. However, upon removal of the pouch 42 from the bag 20 effected by release of the quick-disconnect clip locks 30, the pouch 42 may be converted to a wearable "fanny pack" simply by unzipping the zipper 64 and removing the strap assembly 68, 70 so that they may be deployed around the waist of a user. When positioned on the waist of a user, the outer side of the pouch 42 presenting the flap 54 is exposed to allow the user ready access to the interior of the pouch 42.

Figure 1:
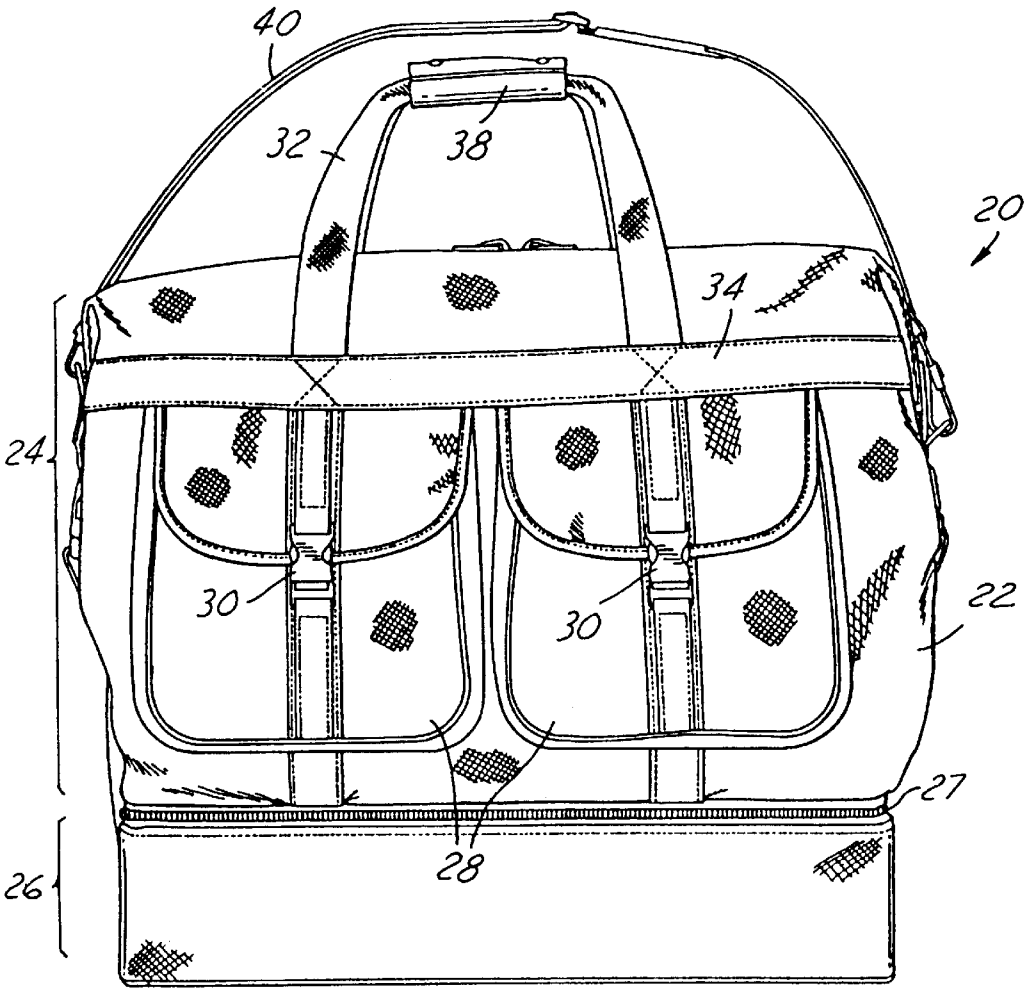
FIG. 1 is an elevational view of one side o f the bag forming the preferred embodiment of the present invention.
Figure 4:
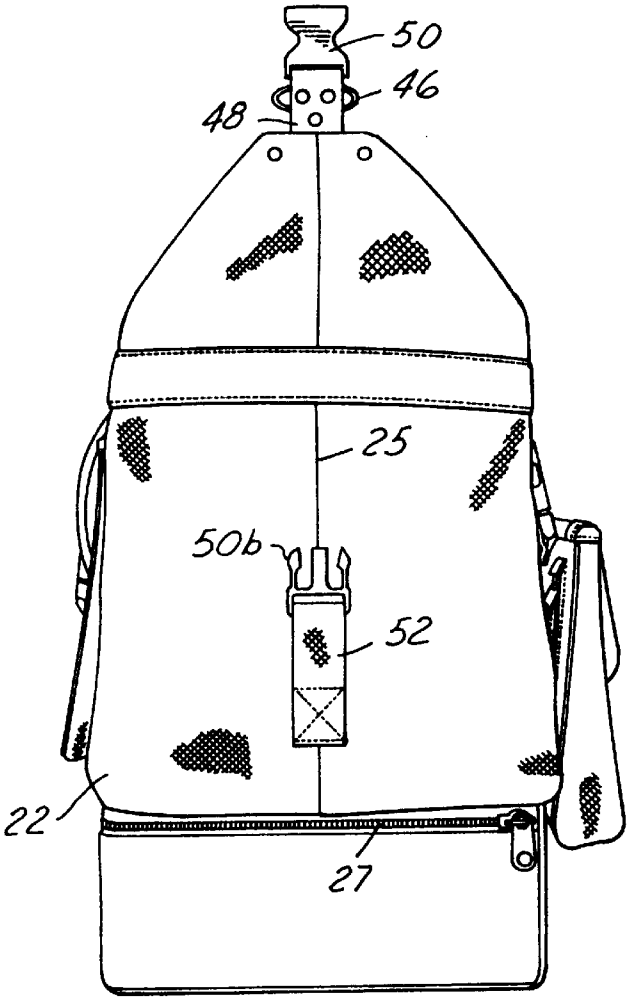
FIG. 4 is a view similar to FIG. 2 but showing the quick-release snap disconnected and the upper compartment expanded.

Referring now particularly to FIGS. 1, 2 and 4, in addition to the hand-carrying strap 32, there is also provided a shoulder strap 40 having at its opposite ends a quickdisconnect snap hook 44 which in turn is secured to a D ring 46. The D ring 46 is secured to a loop 48 attached to the end of the bag body 22. A generally triangularly shaped reinforcement member 45 is sewn over a portion of the bag body 22 and loop 48 to reinforce the point of connection of the D ring to bag. The loop 48 includes a second loop to which there is secured a portion of a quick-disconnect clip 50 which secures one end of the bag adjacent the main access zipper 35 to a loop connection 52 secured to a lower section of the bag body 22. As shown in FIG. 4, the quickdisconnect clip 50 comprises female and male portions 50*a*, 50*b*, which, when released, allow upward expansion of the bag material, thus increasing the volume of the upper part 24 of the bag body 22.

Figure 5:
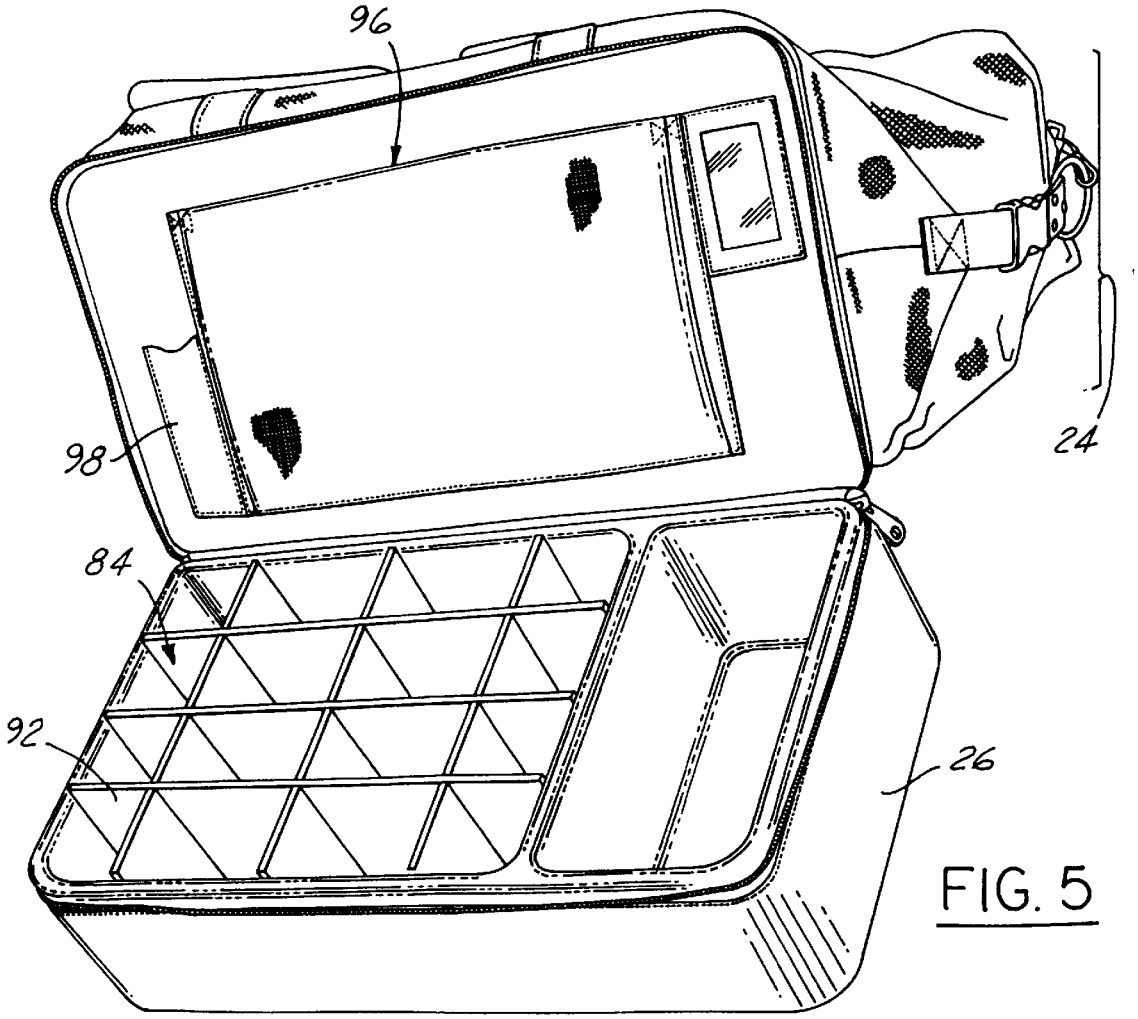
FIG. 5 is a perspective view of the bag of FIG. 1, showing the upper part 24 pivoted rearwardly to reveal the interior of the lower compartment.
Figure 11:
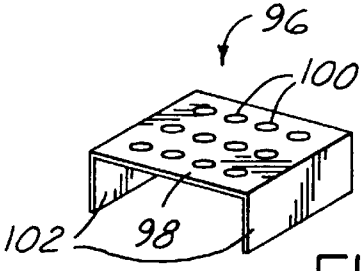
FIG. 11 is a perspective view of an insert for the tray.
Figure 6:
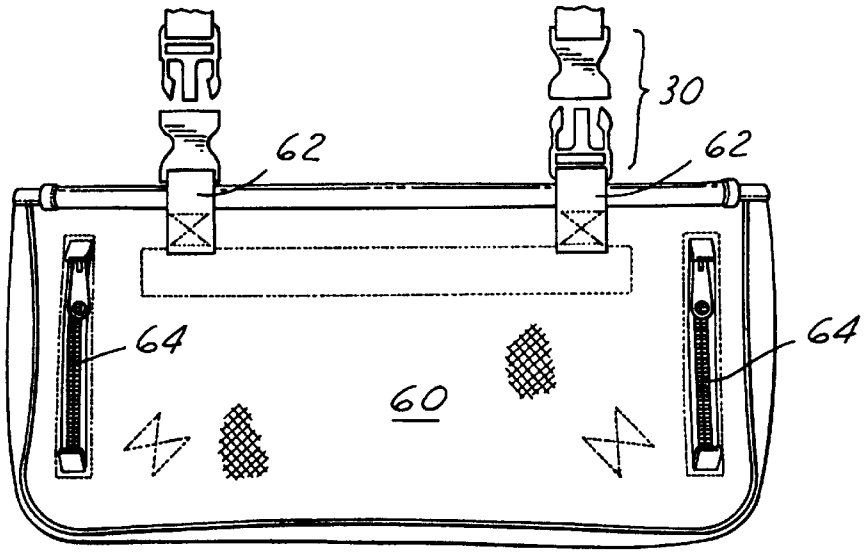
FIG. 6 is a rear, elevational view of the pouch shown in FIG. 3.
Figure 7:
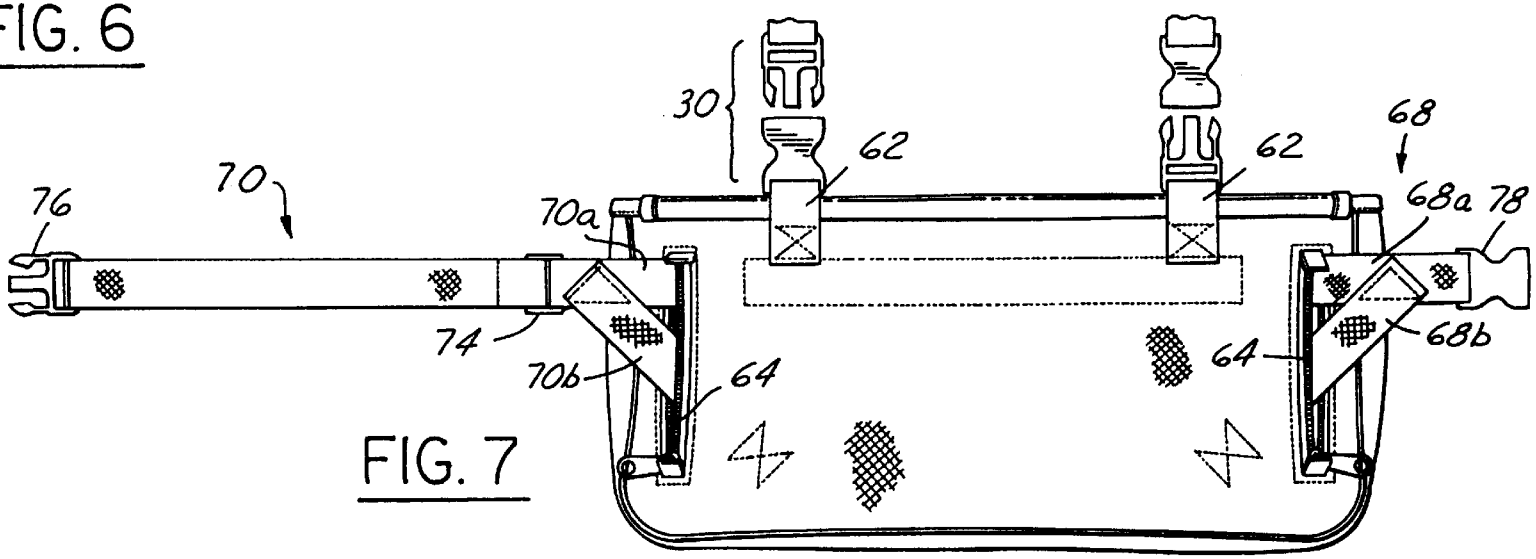
FIG. 7 is a view similar to FIG. 6, but showing the wearable strap assembly deployed.
Figure 8:
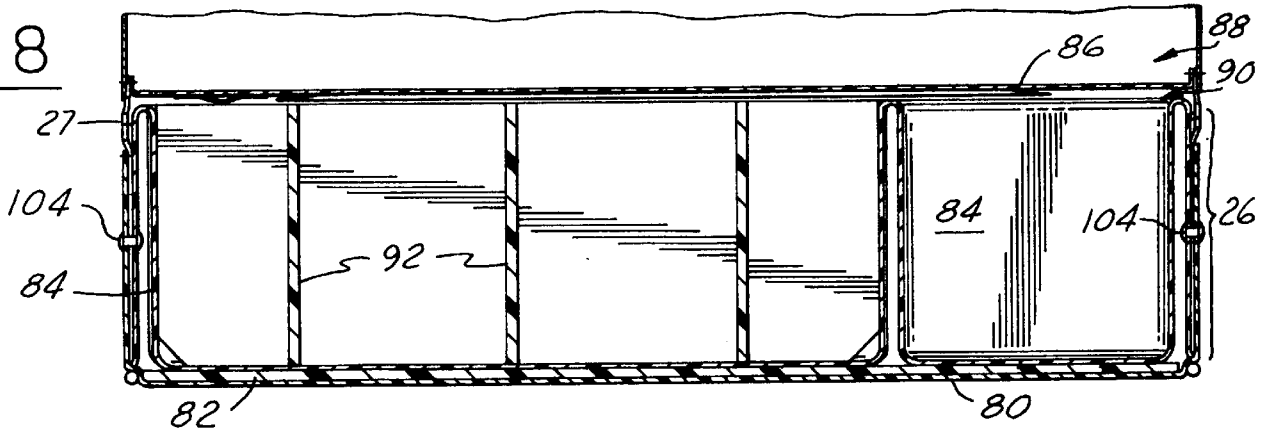
FIG. 8 is a fragmentary, longitudinal sectional view taken through the center of the lower portion of the bag of FIG. 1.

Referring now to FIGS. 1, 5 and 8–10, as previously noted, the upper and lower portions of the bag body 22 are separated by a zipper 27 which extends around three sides of the bag in a single plane, the fourth side of the bag body 22 (carrying the pouch 42) acting as a hinge to allow the upper part 24 to be pivoted rearwardly, thus exposing the lower compartment 90. Within the lower compartment 90, there is provided a rigid, flat sheet or base plate 82 which may be of a plastic material that provides a rigid flat bottom that maintains the shape of the flexible bag bottom, and provides a base upon which is mounted an article storing tray 84. The tray 84 is preferably of a one-piece, plastic molded construction having individual compartments particularly suited to receive article storage mounts or containers therein. For example, there is shown in FIG. 11, an article storing insert in the form of a shotgun shell carrier 96 which is configured to be complementally received within one of the compartments defined in the tray. The carrier may be of a single piece construction comprising a flat top 98, a pair of spaced apart legs 102 and a plurality of apertures 100 in the top for holding shotgun shells therein. If desired, a plurality of interconnecting dividers 92 may be inserted into the tray 84. Grooves 94 may be formed in the side walls of the interior of the tray 84 to receive the ends of the divider 92. As particularly shown in FIG. 5, pouches 96, 98 formed of webbing or solid material may be sewn onto the bottom side of a bottom dividing wall 86 which divides the upper and lower compartments 24, 26. When the top portion 24 is pivoted away from the bottom portion 26, as shown in FIG. 5, the user may gain access to pouches 96, 98 which are disposed in proximity to the tray 84.

The tray 84 is mechanically fastened in any of various manners to the lower portion 26 of the bag body 22, so that the bag body 22 and the tray 84 form a unified, rigid construction. The tray 84 may be secured to the bag body as with rivets 104, Velcro (not shown), an adhesive or the like.

Figure 10:
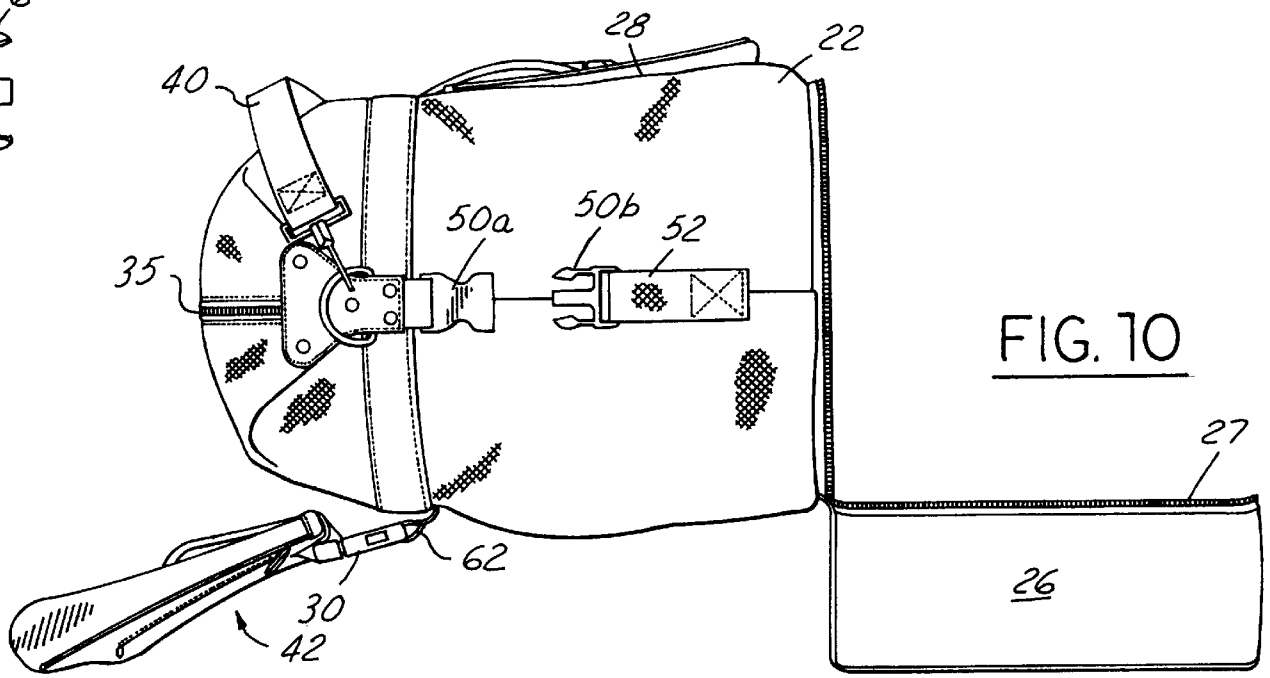
FIG. 10 is an end view of the bag FIG. 1 but showing the upper portion of the bag body pivoted away from the lower portion.
Figure 12:
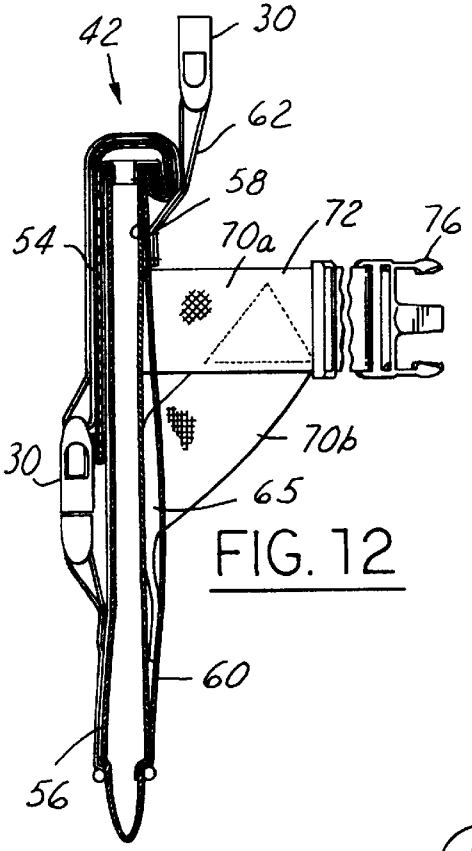
FIG. 12 is a transverse cross-sectional view taken through the center of the pouch shown in FIGS. 6 and 7.

As seen in FIG. 10, when the upper part of the bag is pivoted rearwardly, the pouch 42 may be likewise pivoted outwardly so that the pouch 42, main bag body 22, and the lower part 26 of the bag lie in a side-by-side relationship, thus permitting the user ready access to any of these storage areas.

From the foregoing, it is apparent that the present invention not only accomplishes the objects of the invention, but does so in a particularly effective and advantageous manner. It is recognized, of course, that those skilled in the art may make various modifications and additions to the preferred embodiment chosen to illustrate the invention without departing from the spirit and scope of the present contribution to the art. Accordingly, it is to be understood, that the protection sought and to be afforded hereby should be deemed to extend to the subject matter claimed and all equivalents thereof fairly within the scope of the invention.

I claim:

1. A carrying bag comprising:

a main bag body including an upper portion and a lower portion;

a wearable pouch, said pouch including;

a front;

a back;

a pocket defined in said back;

said back including an inner and an outer wall having it's peripheral edges secured to said inner wall, and said pocket being defined between said inner and outer walls, a strap assembly secured to said inner wall and normally stored in said pocket when said pouch is mounted on said bag; and a releasable mounting means for releasably mounting said pouch on said main bag;

said strap assembly being stored between said inner and outer walls, and including first and second sections, said outer wall including first and second spaced-apart openings therein respectively adjacent opposite ends of said outer wall, said first and second sections being respectively removable from and extending through said first and second openings when said pouch is removed from said bag body and deployed for wearing.

2. The carrying bag of claim 1, wherein said mounting means includes a pair of spaced-apart, manually releasable connectors.

3. The carrying bag of claim 2, wherein a portion of each of said connectors is secured to said strap assembly such that a substantial portion of the weight of said pouch is carried by said strap.

4. The carrying bag of claim 1, wherein each of said first and second openings includes a closure for normally closing the associated opening.

5. The carrying bag of claim 4, when each of said closures includes a zipper.

6. A carrying bag comprising:

a main bag body including an upper portion and a lower portion;

a wearable pouch; and a releasable mounting means for releasably mounting said pouch on said main bag;

said bag body including first, second, third and fourth sides;

said pouch being mounted on said first side;

said bag body including an upper compartment in said upper portion and a lower compartment in said lower portion, and a zippered closure between said upper and lower portions, said zippering closure extending around said second, third and fourth sides of said bag body;

said first side of said bag body including a section lying in the plane of said zippered closure acting as a hinge to allow said upper portion of said bag body to pivot away from said lower portion to reveal said lower compartment, and said releasable mounting means including a hinge connection for pivotally connecting a top part of said pouch to said bag body such that upon pivoting of said upper portion away from said lower portion, said pouch is pivotable away from said upper portion of said bag body so that said upper portion, said lower portion and said pouch lie in side-by-side relationship to each other.

7. The carrying bag of claim 6, wherein said lower portion of said bag body includes a unitary tray for storing articles therein.

8. A carrying bag comprising:

a bag body;

said bag body including an upper portion and a lower portion, and first, second, third and fourth sides;

a divider separating said upper and lower portions and respectively defining upper and lower compartments;

a zippered closure positioned between said upper and lower portions and extending around said second, third and fourth sides of said bag body, opening of said zippered closure allowing access to said lower compartment;

a unitary tray disposed within said lower compartment for storing articles therein; said zippered closure being arranged such that, when open, the upper portion of said bag body may be pivoted away from said lower portion to permit access to said tray; and a wearable pouch removably attached to said first side of said bag body, said wearable pouch including a pocket and deployable strap means within said pocket, said strap means being removable from said pocket when said pouch is removed from said bag body, to allow a user to wear said pouch.

9. The carrying bag of claim 8, wherein said bag body is formed of flexible material and said bag further includes:

a rigid reinforcing plate disposed within said lower compartment, said tray resting upon and supported by said reinforcing plate; and divider means removably mounted within said tray for dividing said tray into a plurality of separate compartments.

10. The carrying bag of claim 9, including at least one insert configured to be received within said tray for holding an article having a specific geometric configuration.

* * * * *